US006021155A

United States Patent [19]

Jones

[11] Patent Number: 6,021,155

[45] Date of Patent: Feb. 1, 2000

[54] HEAT TREATING FURNACE HAVING IMPROVED HOT ZONE

[76] Inventor: William R. Jones, PO Box 205, Telford, Pa. 18969

[21] Appl. No.: 09/306,217

[22] Filed: May 6, 1999

Related U.S. Application Data

[63] Continuation-in-part of application No. 09/027,868, Feb. 23, 1998.

[51] Int. Cl.[7] ..... H05B 3/66

[52] U.S. Cl. ..... 373/130; 373/128; 219/520; 219/532

[58] Field of Search ..... 373/109–112, 114, 373/117, 125, 130, 137, 128, 131; 219/520, 532, 542

[56] References Cited

U.S. PATENT DOCUMENTS 4,056,678 11/1977 Beall, III et al. ..... 373/130
4,259,538 3/1981 Jones ..... 373/130
4,559,631 12/1985 Moller ..... 373/130
4,608,698 8/1986 Moller et al. ..... 373/130
4,612,651 9/1986 Moller et al. ..... 373/130
5,497,394 3/1996 Jhawar et al. ..... 373/130

*Primary Examiner*—Tu Ba Hoang

[57] ABSTRACT

The present invention provides a high temperature vacuum furnace including a hot zone, which is made for heavy-duty heat treating applications. In a preferred embodiment, the hot zone chamber has an outer and an inner wall. The inner wall includes a heat shield secured to it for containing radiant energy. The hot zone chamber further includes a plurality of banks of electric resistance heating elements spaced axially within the chamber. Heating elements in furnaces according to this invention have a specially designed width-to-thickness aspect ratio, which enables heating elements to have a longer life between replacements. These heating elements can be designed in polygon banks or arrays, which virtually completely surround the workpiece and provide maximum temperature uniformity during heating.

5 Claims, 4 Drawing Sheets

VIEW LOOKING INTO FURNACE (VACUUM FURNACE 100)

VIEW LOOKING INTO FURNACE (VACUUM FURNACE 100)

HEAT TREATING FURNACE HAVING IMPROVED HOT ZONE

Figure 1:
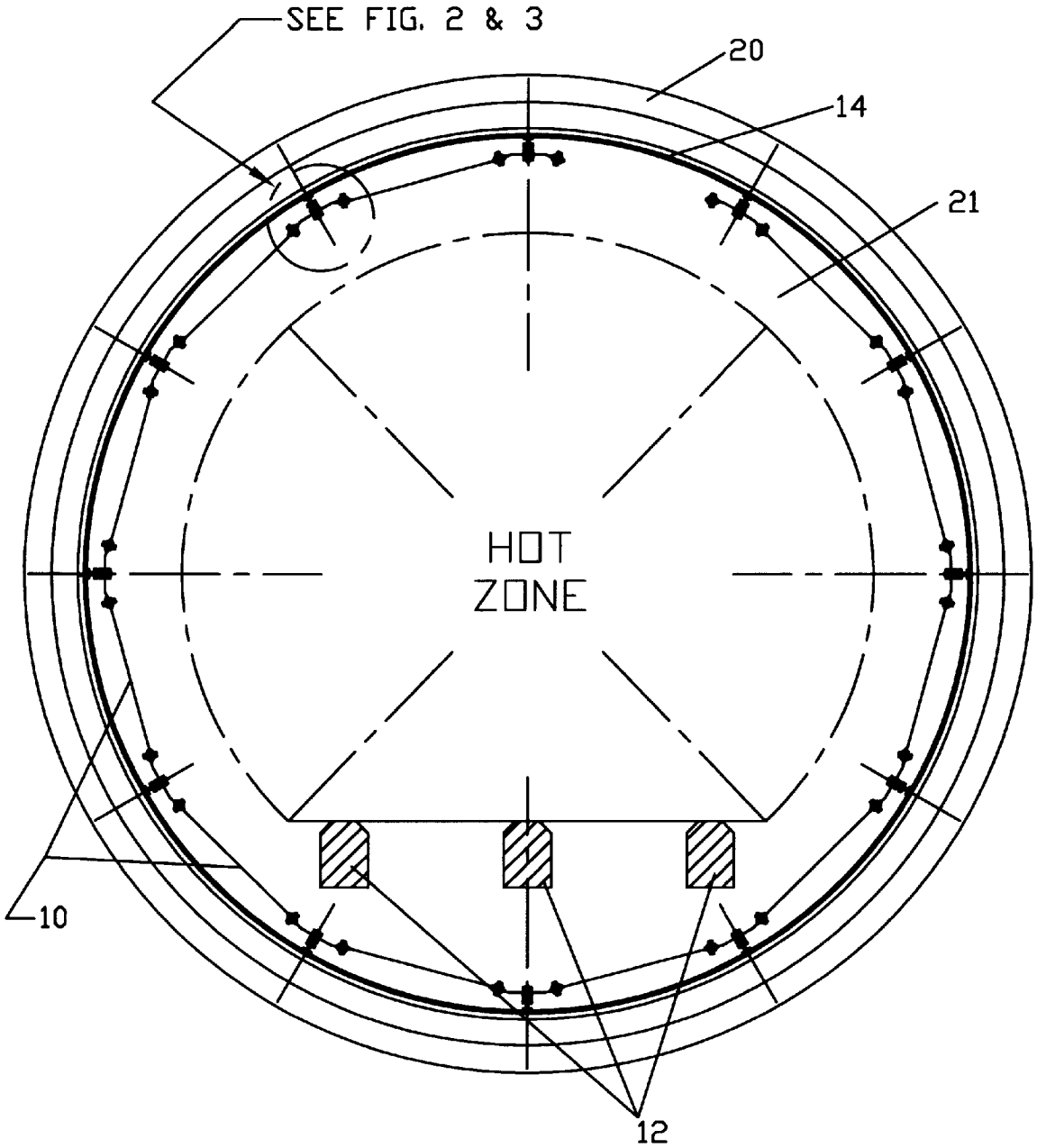

This application is a continuation in part of U.S. application Ser. No. 09/027,868 filed Feb. 23, 1998.

FIELD OF THE INVENTION

This invention relates to heat treating furnaces which employ electric resistance heating elements, and, in particular, to an improved hot zone design for minimizing heating element failure.

BACKGROUND OF THE INVENTION

Vacuum heat treating furnaces which employ electrical resistance heating elements are well known. Popular designs are presented in U.S. Pat. Nos. 4,559,631 and 4,259,538.

A typical vacuum furnace has a furnace wall and a hot zone chamber of a circular cross-section which houses a series of banks of axial-spaced electrical resistance heating elements suspended from an inner wall of the hot zone chamber by a series of support rods. A heating element is generally made from graphite or molybdenum alloy, and generates radiant heat in response to electrical current passing therethrough.

Over the life of an average furnace the heating elements are subjected to many expansions and contractions as a result of hundreds of heating and cooling cycles. Since only the ends of each of the elements is fixed, these heating and cooling cycles can cause the elements to undergo deformation. As a result of this deformation, the heating elements tend to bow. Stress caused by such deformation can also result in fractures which in turn necessitate replacement of the heating elements.

SUMMARY OF THE INVENTION

The present invention provides, in a preferred embodiment, a vacuum furnace including a hot zone chamber having an outer and an inner wall. The inner wall includes a heat shield secured to it for containing radiant energy. The hot zone chamber further includes a plurality of banks of electric resistance heating elements spaced axially within the chamber. The heating elements are preferably formed of a relatively pure molybdenum (commercially pure molybdenum) but can be made from other suitable refractory materials, including molybdenum alloys. The preferred molybdenum develops temperatures in the range of 2500 to 2650 degrees F. A substantial number of these elements include a width-to-thickness ratio of no greater than 80 which greatly resists failure during use.

Accordingly, a furnace employing this invention provides a hot zone which is made for heavy duty heat treating applications. The specially designed width-to-thickness aspect ratio of this invention enables heating elements to have a longer life between replacements. These heating elements can be designed in polygon banks or arrays which virtually completely surround the workpiece and provide maximum temperature uniformity during heating.

The vacuum furnace may also include a hot zone having a generally cylindrical outer wall and an inner wall having a heat shield. The hot zone chamber is further defined by a plurality of spaced polygons of electrical resistance heating elements formed to take the shape of a polygon located intermittently along the chamber. Each of the polygons comprises a plurality of heating elements sandwiched at their transverse ends between a stabilizer bar and a compensator bar. The compensator bars of this embodiment are contoured to provide a shape to the polygon, for example an octagon or pentagon. The polygons are connected to the inner wall of the hot zone chamber by a plurality of support rods which support each of the polygons a distance away from the heat shield. In a preferred embodiment, the heating elements are formed from relatively pure (commercially pure) molybdenum having a width-to-thickness aspect ratio of no greater than 80.

A BRIEF DESCRIPTION OF THE DRAWINGS

Figure 2:
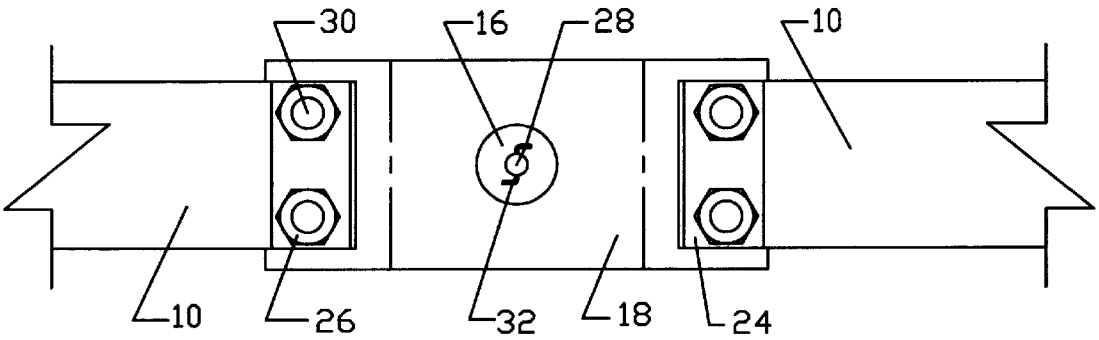
Figure 3:
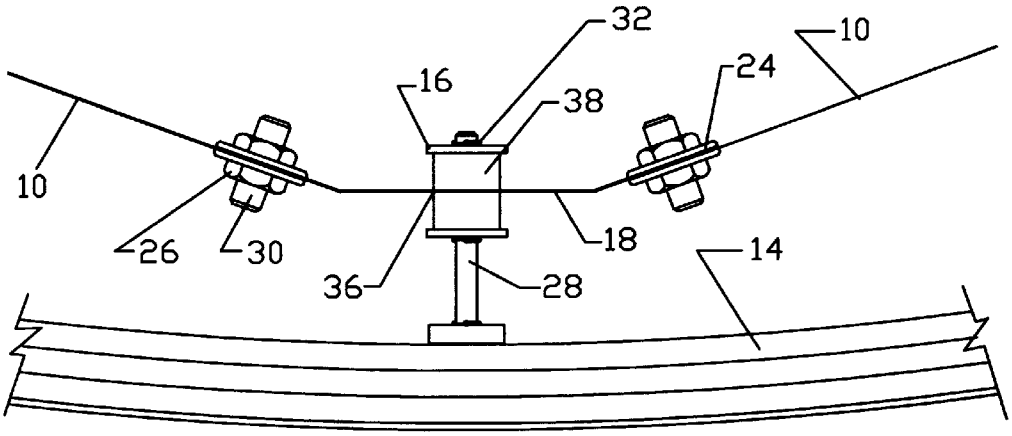
Figure 4A:
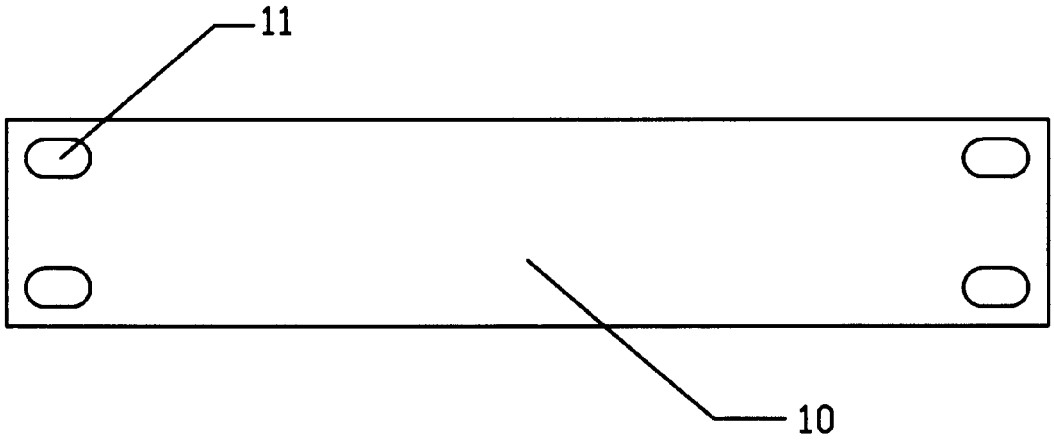
Figure 4B:
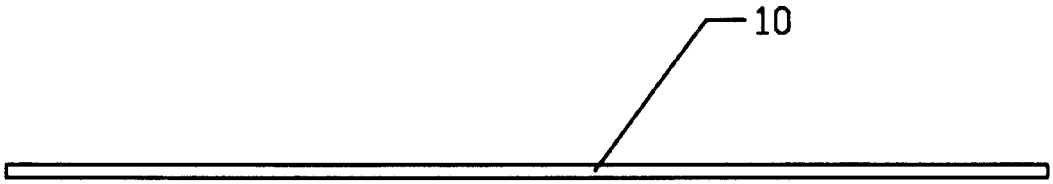
Figure 5A:
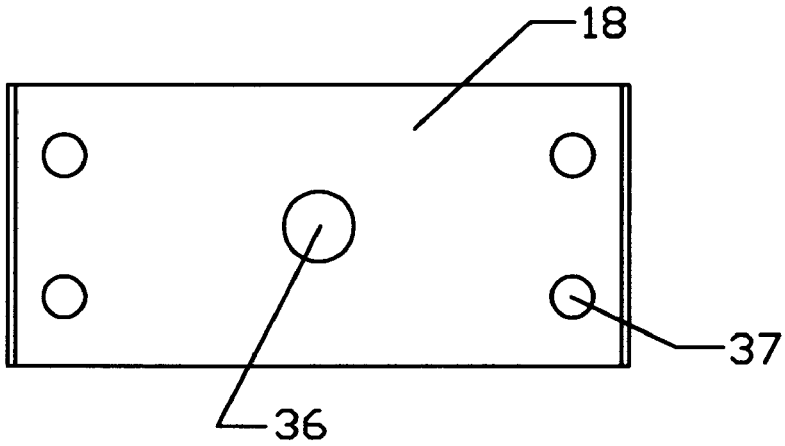
Figure 5B:
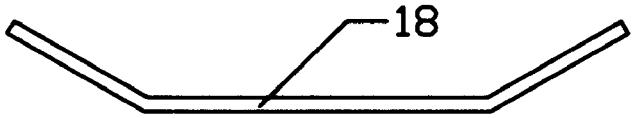
Figure 6A:
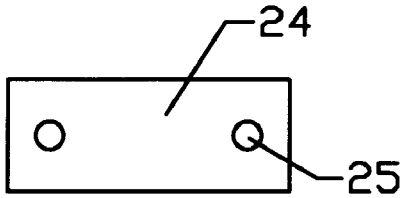
Figure 6B:
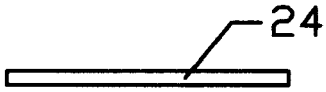

The accompanying drawings illustrate preferred embodiments of the invention, as well as other information pertinent to the disclosure, in which:

FIG. 1: is a front perspective view of a preferred vacuum furnace of this invention;

FIG. 2: is a top partial plan view of the heating element of this invention;

FIG. 3: is a side partial plan view of the heating element connection of FIG. 2;

FIGS. 4(*a*)–(*b*): are top and side plan views of a preferred heating element of this invention;

FIGS. 5(*a*)–(*b*): are top and side plan views of a preferred compensator bar of this invention; and FIGS. 6(*a*)–(*b*): are top and side plan views of a preferred stabilizer bar of this invention.

A DEATAILED DESACRIPTION OF THE INVENTION

With reference to the figures, and particularly to FIGS. 1–3, there is shown a preferred vacuum furnace 100 of this invention. The furnace 100 typically includes an outer wall 20 which supports a hot zone chamber 21. The hot zone chamber 21 includes an inner and outer wall, the inner wall which includes a heat shield 14, or other heat insulating means designed to impede heat transmission from the hot zone chamber 21. The heat insulation means can contain a layer of KAOWOOL, a layer of graphite felt, and a sheet of reflective GRAFOIL. These are common insulating and reflective materials known by those in the vacuum furnace industry.

In general, the furnace 100 usually is formed in a substantially cylindrical shape having a substantially circular internal cross-section which is closed at its forward end by a releasable door. The hot zone chamber 21 can include an internal structure in the form of a walled enclosure disposed inside the outer wall 20 of the furnace and spaced inwardly from the outer wall 20.

The hot zone chamber 21 comprises a plurality of banks of electric resistance heating elements 10. These heating elements 10 can be fabricated from graphite or other refractory material, but are preferably of relatively pure (commercially pure) molybdenum metal, and are typically rigid, elongated straight bars, having a rectangular cross section. The heating elements 10 are preferably oriented end-to-end with one another to form a series of ring-like banks spaced longitudinally within the hot zone chamber 21. These ring-like banks preferably form a polygon of five to about ten heating elements.

In a preferred embodiment of this invention, the vacuum furnace 100 includes about six to ten longitudinally spaced banks of heating elements 10, each bank being formed by eight separate elements 10 as shown in FIG. 4*a*. The elements 10 preferably include oblong-shaped apertures 11 located approximately near their four corners. These apertures are used for connecting the preferred heating element 10 to the preferred compensator bar 18 and stabilizer bars 24 through their own mounting holes 37 and 25, espectively, as shown in FIGS. 2 and 3, 5*a* and 6*a*. In the preferred embodiment, the heating elements 10 are electrically and mechanically connected to the compensator and stabilizer bars 18 and 24 by a series of threaded bolts 30 and retaining nuts 26.

As FIG. 3 depicts, the compensator bar 18 contains a central hole 36 for receiving an insulation sleeve 38. The insulation sleeve 38 is fitted around one of the support rods 28 and is preferably fixed thereto by pin retainers 32. The insulation sleeve 38 is made from a ceramic, such as alumina. Accordingly, the heating elements 10, Compensator bar 18 and stabilizer bars 24 are electrically isolated from the support rods 28.

In the embodiment illustrated in FIG. 1 the heating element bank is not formed into a complete loop, but has two ends at which an electrical power source is connected. If the banks of heating elements were not electrically isolated from the support rods 28, and the mounting rod were connected to ground, a short circuit would occur which could cause damage to the furnace.

In addition to the insulation sleeve 38, a pair of disk-like shields or washers 16 are provided above and below the insulation sleeve 38. These washers 16 are preferably made of molybdenum or graphite although other similar refractory metal and ceramic materials could be used. The washers 16 have central apertures large enough to permit the passage of the support rods 28. They are designed to expand and/or compress around the support rods 28 to provide a shield against vapor coming to rest along the support rod and onto the compensator bar 18 or heating element 10. This can avoid the incidence of electrical short circuits therebetween.

The operation of the preferred vacuum furnace, as well as preferred embodiments of the heating elements 10 will now be described.

After a workpiece has been introduced into the hot zone chamber 21, electric current is passed through the banks of electric resistance heating elements 10 to generate radiant heat. After the heat treatment cycle is complete, inert cooling gas, such as argon or nitrogen, is introduced into the hot zone chamber 21 in order to quench the workpiece.

It has been found that because of the numerous cycles of heating (expansion) and cooling (compression) that the heating elements experience, and their structure which typically includes dimensions of about 3.0 inches wide by 0.025 inches in thickness, even high temperature molybdenum elements have been found to creep deform. It has also been found that furnace malfunctions result from element failure due to this deformation. Interestingly, such deformations are found to be frequent in vertically or near vertically oriented elements.

The use of relatively pure (commercially pure) molybdenum has been found to reduce the tendency of the elements 10 to deform. Thus the preferred heating elements 10 of this invention are relatively pure molybdenum. However, this invention relies upon using heating elements having the preferred width-to-thickness aspect ratio. In a typical prior art heating element using a 3.0 inch width and a 0.025 inch thickness the width-to-thickness ratio is 120. Although gravitational forces might be expected to have a higher impact on thin elements, that impact would not appear to account for the high incidence of failure in elements that are disposed or approach the vertical. The advantages of using thin (high width-to-thickness aspect ratio) elements had pushed the industry to using as high a ratio as practical.

In accordance with this invention, rather than using high aspect ratio elements, the preferred elements have an aspect ratio of less than about 80 (for example, corresponding to dimensions for the heating elements of about 2.6 inches wide by about 0.0325 inches thick). An especially preferred embodiment of this invention uses a ratio of more than about 15 to no greater than about 53 (for example, corresponding to dimensions for the heating elements of about 2 inches wide by about 0.0375 inches thick). In the most preferred embodiment the width-to thickness ratio is less than 25, most desirably between about 15 and 25 (for example, corresponding to dimensions of about 1 inch wide by 0.066 inches thick and 1.25 inches wide by 0.050 inches thick, respectively.

If the cross-sectional area of the elements is at least within about 98%–102%, and preferably within +/−0.005 % of the cross-sectional area of the elements being replaced (either in the design and construction of new furnace or in the repair of an existing furnace) the heating elements of this invention can be substituted in existing furnace designs and fabrications without redesigning power consumption or instrumentation requirements. This is especially valuable in the repair of existing furnaces.

Accordingly, in a repair of an existing furnace (including preventative maintenance replacement) it is necessary to determine the composition and the dimensions of the element (which can include an element section) to be replaced. According to this invention the dimensional determination would also require determining the cross-sectional area of the heating element. The replacement then would be an element having a thicker and narrower element than previously existed in the furnace. The replacement can be accomplished by conventional means, for example by using high refractory metal bolts or the connection system described above, whichever is appropriate for the furnace to be repaired.

The hot zone of this invention can operate within a temperature range of about 400 to 2500 degrees F., and optionally up to about 3000 degrees F. with a high degree of temperature uniformity and long product life. The hot zone preferably has a work capacity at 2100 degrees F. of at least 1000 pounds with a heating element loop of at least 20–34 inches in diameter. The system is designed to operate in conjunction with a roughing pump and a diffusion pump with the overall system operating in a vacuum range of about $10^{-5}$ Torr.

From the forgoing, it can be understood that this invention provides improved vacuum furnaces and hot zone chambers suitable for vacuum furnaces which prolong the life of the heating elements and provide greater creep resistance and long term cycle life. Although various embodiments have been illustrated, this is for the purpose of describing, but not limiting the invention. Various modifications, which will become apparent to one skilled in the art, are within the scope of this invention described in the appended claims.

What is claimed is:

1. A vacuum furnace comprising an outer wall, a hot zone chamber including an inner wall having a heat shield secured thereto, said hot zone chamber further comprising a plurality of spaced polygons having electrical resistance heating elements linked together by stabilizer bars and compensator bars arranged to shape said polygons, a substantial number of said heating elements having a width to thickness aspect ratio of less than about 80.

2. The furnace of claim 1 wherein the element consists of commercially pure molybdenum.

3. The furnace of claim 1 wherein said aspect ratio is less than about 53.

4. The furnace of claim 1 wherein said aspect ratio is less than about 53 and greater than about 15.

5. The furnace of claim 1 wherein the substantial number of heating elements consist of commercially pure molybdenum and said aspect ratio of said elements is less than about 25 and greater than about 15.

* * * * *